US010968646B1

(12) United States Patent
Brown

(10) Patent No.: US 10,968,646 B1
(45) Date of Patent: Apr. 6, 2021

(54) ROOFING SAFETY LINE ENGAGEMENT ASSEMBLY

(71) Applicant: William Brown, Oak Harbor, WA (US)

(72) Inventor: William Brown, Oak Harbor, WA (US)

( * ) Notice: Subject to any disclaimer, the term of this patent is extended or adjusted under 35 U.S.C. 154(b) by 0 days.

(21) Appl. No.: 15/930,525

(22) Filed: May 13, 2020

(51) Int. Cl.
*E04G 21/32* (2006.01)

(52) U.S. Cl.
CPC ..... *E04G 21/328* (2013.01)

(58) Field of Classification Search
USPC ..... 248/237; 182/3
See application file for complete search history.

(56) References Cited

U.S. PATENT DOCUMENTS 2,735,639 A * 2/1956 Gilfry ..... H01Q 1/1221 248/536
5,361,558 A * 11/1994 Thornton ..... A62B 35/0068 52/698
5,730,407 A * 3/1998 Ostrobrod ..... A62B 35/0043 182/231
5,896,719 A * 4/1999 Thornton ..... A62B 35/0068 52/698
6,729,101 B2 5/2004 Macri
7,665,248 B2 2/2010 Blackford
7,814,938 B2 * 10/2010 Davis, Jr. ..... A62B 1/16 138/106
8,746,402 B2 6/2014 Nichols, Jr.
D789,563 S 6/2017 Lopez
9,951,557 B2 4/2018 Roseveare, Jr.
2006/0059844 A1 * 3/2006 Ely ..... E04G 21/3261 52/698
2006/0059858 A1 * 3/2006 Layman ..... E04D 15/02 52/749.12
2007/0278037 A1 12/2007 Michel
2008/0271407 A1 * 11/2008 Snider ..... E04D 13/12 52/745.06
2008/0302934 A1 12/2008 Nelson
2012/0067667 A1 3/2012 Marcoux
2014/0251724 A1 * 9/2014 Nichols, Jr. ..... A62B 35/0068 182/3

* cited by examiner

*Primary Examiner* — Monica E Millner

(57) ABSTRACT

A roofing safety line engagement assembly includes a plate that has a top side, a bottom side and a perimeter edge. The perimeter edge includes a front edge, a rear edge, a first lateral edge and a second lateral edge. The first lateral edge has a plurality of slots therein. Each of the slots engages a nail extended into a roof. The slots are angled toward the front edge such that an angle between each of the slots and the first lateral edge is less than 60°. A catch is attached to and extends upwardly from the plate. The catch is positioned adjacent to the rear edge and releasably engages a safety line.

8 Claims, 4 Drawing Sheets

ROOFING SAFETY LINE ENGAGEMENT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to safety line attachment point device and more particularly pertains to a new safety line attachment point device that allows a roofer to secure a safety attachment point to a roof while roofing without interfering with the process of attaching shingles to the roof.

(2) Description of Related Art Including Information Disclosed Under 37 CFR 1.97 and 1.98

The prior art relates to safety line attachment point devices that are used while roofing or, more particularly, shingling a roof.

BRIEF SUMMARY OF THE INVENTION

An embodiment of the disclosure meets the needs presented above by generally comprising a plate that has a top side, a bottom side and a perimeter edge. The perimeter edge includes a front edge, a rear edge, a first lateral edge and a second lateral edge. The first lateral edge has a plurality of slots therein. Each of the slots engages a nail extended into a roof. The slots are angled toward the front edge such that an angle between each of the slots and the first lateral edge is less than 60°. A catch is attached to and extends upwardly from the plate. The catch is positioned adjacent to the rear edge and releasably engages a safety line.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
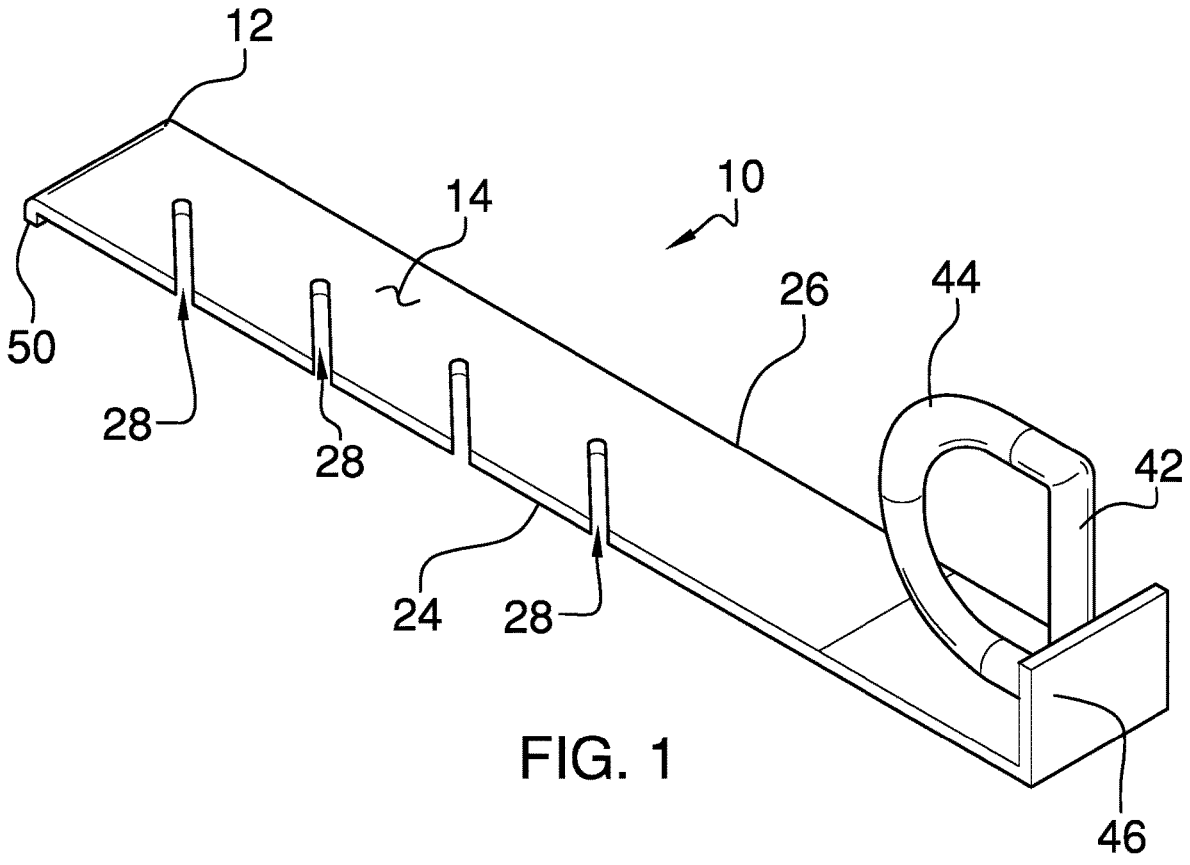
FIG. 1 is a top isometric view of a roofing safety line engagement assembly according to an embodiment of the disclosure.
Figure 2:
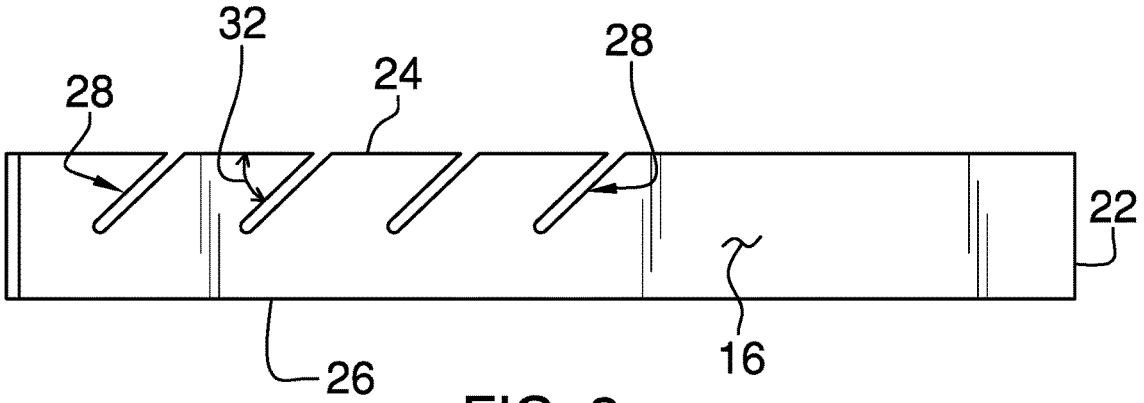
FIG. 2 is a bottom view of an embodiment of the disclosure.
Figure 3:
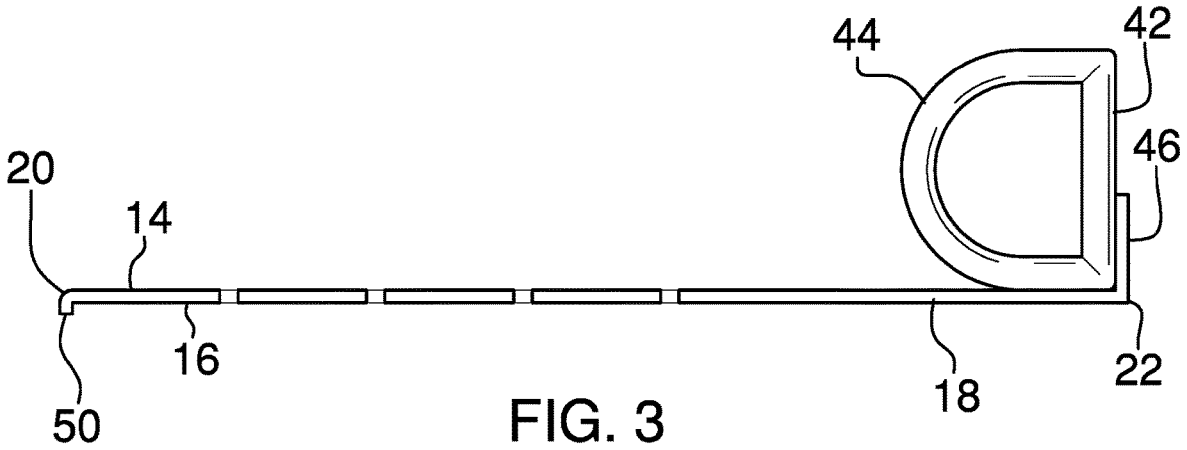
FIG. 3 is a side view of an embodiment of the disclosure.
Figure 4:
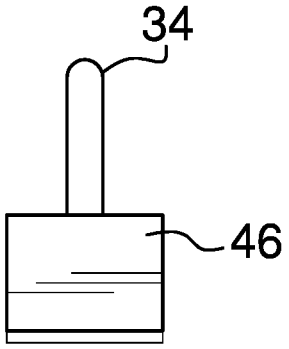
FIG. 4 is a rear view of an embodiment of the disclosure.
Figure 5:
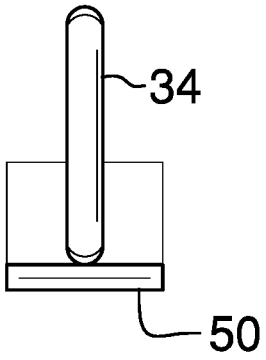
FIG. 5 is a front view of an embodiment of the disclosure.
Figure 6:
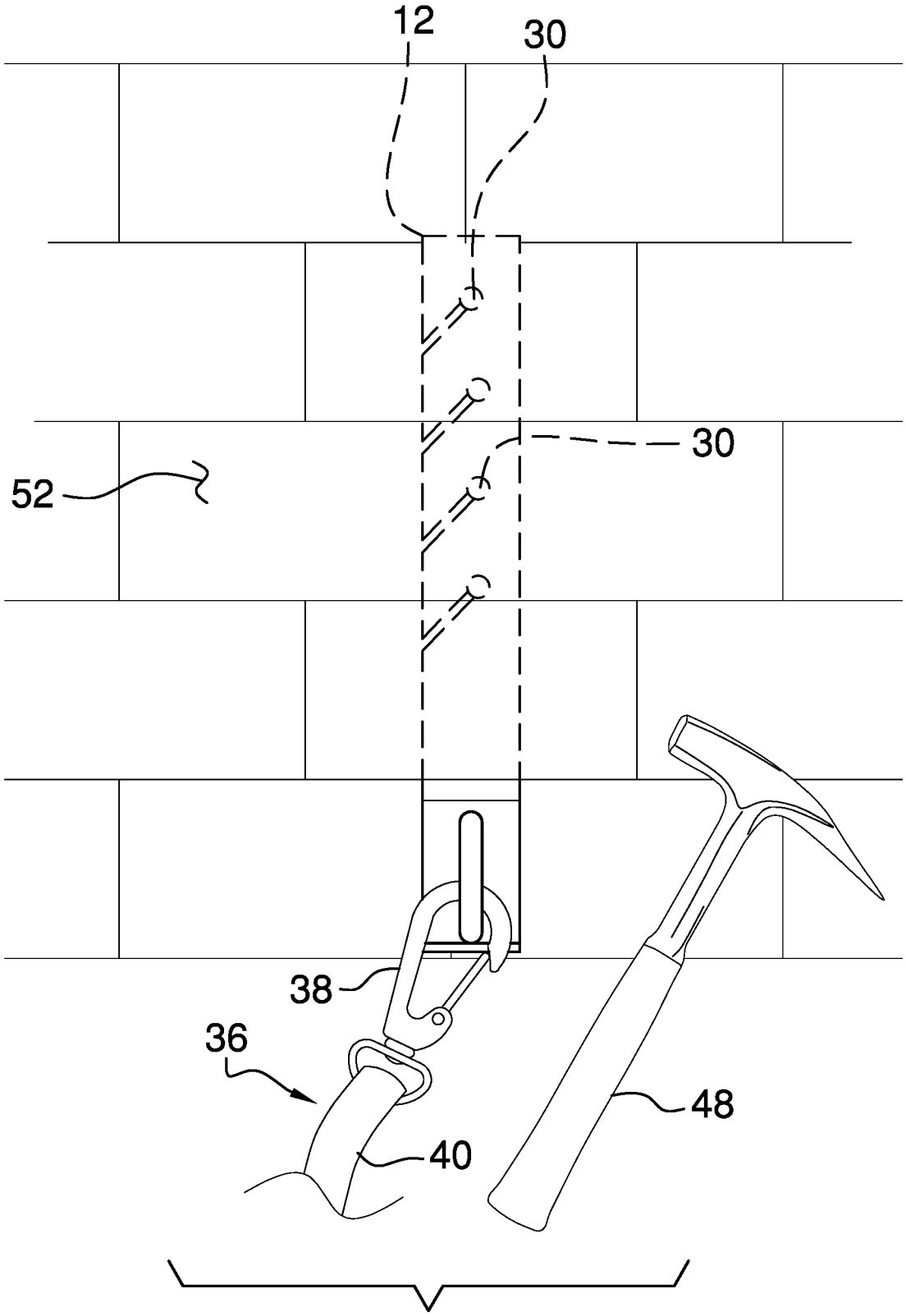
FIG. 6 is a top in-use view of an embodiment of the disclosure.

With reference now to the drawings, and in particular to FIGS. 1 through 6 thereof, a new safety line attachment point device embodying the principles and concepts of an embodiment of the disclosure and generally designated by the reference numeral 10 will be described.

As best illustrated in FIGS. 1 through 6, the roofing safety line engagement assembly 10 generally comprises a plate 12 that has a top side 14, a bottom side 16 and a perimeter edge 18. The perimeter edge 18 includes a front edge 20, a rear edge 22, a first lateral edge 24 and a second lateral edge 26. The first lateral edge 24 has a plurality of slots 28 therein, wherein each of the slots is elongated. Each of the slots 28 is configured to engage a nail 30 extended into a roof. In particular, one or more nails 30 are extended through the slots 28 and driven into the roof which is being shingled such that the nails 30 prevent the panel 12 from sliding down the roof in the direction of the rear edge 22. The slots 28 are angled toward the front edge 20 such that an angle 32 between each of the slots 28 and the first lateral edge 24 is less than 60°. Thus, when the panel 12 is moved toward the front edge 20, the panel 12 can slide off of the nails 30. The plate 12 is comprised of a metallic material such as steel, aluminum, or other similar materials.

The slots 28 extend toward a middle area of the plate 12 positioned approximately equidistant from the first 24 and second 26 lateral edges. The plate 12 has a width from the first lateral edge 24 to the second lateral edge 26 that is between 1.0 inches and 4.0 inches. In some embodiments the width is equal to 2.0 inches. The plate 12 has a length from the front edge 20 to the rear edge 22 that is between 10.0 inches and 24.0 inches and in some embodiments is equal to 16.0 inches.

A catch 34 is attached to and extends upwardly from the plate 12. The catch 34 is positioned adjacent to the rear edge 22 and is configured to releasably engage a safety line 36. The catch 34 may comprise a closed loop for receiving a carbineer 38 attached to a rope 40. The catch 34 may be D-shaped and include a straight portion 42 and an arcuate portion 44. The straight portion 42 is positioned adjacent to the rear edge 22 and the arcuate portion 44 extends toward the front edge 20.

A strike panel 46 is attached to and extends upwardly from the rear edge 22. The strike panel 46 may be struck by a hammer 48 to dislodge the panel 12 from the nails 30. The strike panel 46 forms an angle with the top side 16 that is between 80° and 100° and will typically be orientated perpendicular to the top side. The strike panel 46 extends upwardly from the top side 16 a distance between 1.0 inches 4.0 inches. A flange 50 may be attached to and extend downwardly from the front edge 20 of the plate 12. The flange 50 extends away from the plate 12 a distance of less than 0.25 inches and is used to engage an upper edge of a shingle panel 52.

In use, the plate 12 is positioned on a shingle panel 52 and nails 30 are driven through the slots 28 and into a roof. The safety line 36 is then attached to the catch 34 and can be used to secure a roofer to the roof. The shingling is continued and subsequent shingle panels 52 can be placed over the panel 12 and nails 30 and secured to the roof. This protects the nails 30 from the elements after removal of the plate 12. Once the roofer is completed or needs to move the safety line 36, the hammer 48 is used to hit the strike panel 46 to cause the plate 12 to move forwardly and in the direction of the second lateral edge 26 to remove the plate 12 from the nails 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A roofer safety hold assembly configured to be releasably engaged to a roof to provide a hold for a safety line, the assembly comprising:

a plate having a top side, a bottom side and a perimeter edge, the perimeter edge including a front edge, a rear edge, a first lateral edge and a second lateral edge, the first lateral edge having a plurality of slots therein wherein each of the slots is elongated, each of the slots being configured to engage a nail extended into a roof, the slots being angled toward the front edge such that an angle between each of the slots and the first lateral edge is less than 60°;

a catch being attached to and extending upwardly from the plate, the catch being positioned adjacent to the rear edge, the catch being configured to releasably engage a safety line, the catch comprising a closed loop, the closed loop being D-shaped and includes a straight portion and an arcuate portion, the straight portion being positioned adjacent to the rear edge, the arcuate portion extending toward the front edge; and a strike panel being attached to and extending upwardly from the rear edge, the strike panel forming an angle with the top side being between 80° and 100°, the catch being positioned between the strike panel and the top side of the plate such that the straight portion abuts the strike panel and a section of the arcuate portion abuts the top side of the plate, a length of the strike panel extending from the top side of the plate being less than a length of the straight portion of the closed loop wherein the straight portion projects away from a distal edge of the strike panel.

2. The roofer safety hold assembly according to claim 1, wherein the plate has a width from the first lateral edge to the second lateral edge being between 1.0 inches and 4.0 inches, the plate having a length from the front edge to the rear edge being between 10.0 inches and 24.0 inches.

3. The roofer safety hold assembly according to claim 1, wherein the strike panel extends upwardly from the top side a distance between 1.0 inches 4.0 inches.

4. The roofer safety hold assembly according to claim 1, further including a flange being attached to and extending downwardly from the front edge of the plate.

5. The roofer safety hold assembly according to claim 4, wherein the flange extends away from the plate a distance of less than 0.25 inches.

6. The roofer safety hold assembly according to claim 1, further including a flange being attached to and extending downwardly from the front edge of the plate.

7. The roofer safety hold assembly according to claim 6, wherein the flange extends away from the plate a distance of less than 0.25 inches.

8. A roofer safety hold assembly configured to be releasably engaged to a roof to provide a hold for a safety line, the assembly comprising:

a plate having a top side, a bottom side and a perimeter edge, the perimeter edge including a front edge, a rear edge, a first lateral edge and a second lateral edge, the first lateral edge having a plurality of slots therein, each of the slots being configured to engage a nail extended into a roof, the slots being angled toward the front edge such that an angle between each of the slots and the first lateral edge is less than 60°, the plate having a width from the first lateral edge to the second lateral edge being between 1.0 inches and 4.0 inches, the plate having a length from the front edge to the rear edge being between 10.0 inches and 24.0 inches, the plate being comprised of a metallic material;

a catch being attached to and extending upwardly from the plate, the catch being positioned adjacent to the rear edge, the catch being configured to releasably engage a safety line, the catch comprising a closed loop being D-shaped and including a straight portion and an arcuate portion, the straight portion being positioned adjacent to the rear edge, the arcuate portion extending toward the front edge;

a strike panel being attached to and extending upwardly from the rear edge, the strike panel forming an angle with the top side being between 80° and 100°, the catch being positioned between the strike panel and the top side of the plate such that the straight portion abuts the strike panel and a section of the arcuate portion abuts the top side of the plate, a length of the strike panel extending from the top side of the plate being less than a length of the straight portion of the closed loop wherein the straight portion projects away from a distal edge of the strike panel, the strike panel extending upwardly from the top side a distance between 1.0 inches 4.0 inches; and a flange being attached to and extending downwardly from the front edge of the plate, the flange extending away from the plate a distance of less than 0.25 inches.

* * * * *